US005307044A

United States Patent [19]

Watabe

[11] Patent Number: 5,307,044

[45] Date of Patent: Apr. 26, 1994

[54] WOUND CORE

[75] Inventor: Tadatoshi Watabe, Tokyo, Japan

[73] Assignee: Denki Tetsushin Industrial Co., Ltd., Tokyo, Japan

[21] Appl. No.: 971,659

[22] Filed: Nov. 5, 1992

[30] Foreign Application Priority Data

Sep. 3, 1992 [JP] Japan ..... 4-277645

[51] Int. Cl.[5] ..... H01F 27/24; H01F 27/30

[52] U.S. Cl. ..... 336/198; 29/605; 336/213; 336/234

[58] Field of Search ..... 336/213, 233, 234, 208, 336/198, 212; 29/605, 606

[56] References Cited

U.S. PATENT DOCUMENTS

| | | | |
|---|---|---|---|
| 2,199,116 | 4/1940 | Sanders | 336/213 |
| 2,314,912 | 3/1943 | Troy | 336/213 |
| 4,844,312 | 7/1989 | Gomi et al. | 226/21 |
| 4,848,684 | 7/1989 | Sasaki et al. | 336/212 |
| 5,210,930 | 5/1993 | Watabe et al. | 29/609 |

FOREIGN PATENT DOCUMENTS

| | | | |
|---|---|---|---|
| 55-115307 | 9/1980 | Japan | 336/198 |
| 61-22851 | 6/1986 | Japan . | |
| 2-113509 | 4/1990 | Japan . | |
| 3-55964 | 8/1991 | Japan . | |

*Primary Examiner*—Thomas J. Kozma
*Attorney, Agent, or Firm*—Nikaido, Marmelstein, Murray & Oram

[57] ABSTRACT

A wound core, around which electric wires are wound by rotating cylindrical bobbins attached. At least one of a winding start portion and a winding end portion is formed into a trapezoidal cross-sectional shape and the other portion is formed into a circular cross-sectional shape, forming a gap between the trapezoidal cross-sectional shape portion and the bobbin. The rotation of the bobbin without scratch is assured even if the wound core is formed slightly deformed. In cutting-off the material, since the magnitude of the directional change of the cutting tool is decreased at the trailing end and the leading end of the material, the cutting speed is improved.

1 Claim, 3 Drawing Sheets

WOUND CORE

FIELD OF THE INVENTION

The present invention relates to a wound core used for a transformer and the like, and particularly, to a wound core around which electric wires are to be wound by the rotation of attached cylindrical bobbins.

DESCRIPTION OF THE RELATED ART

For winding electric wires around a wound core, there has been used the following method; namely, electric wires are wound around a wound core by the rotation of divisible cylindrical bobbins respectively attached around leg portions of the wound core. In this method, there has been widely used such a wound core as being formed in an approximately circular cross-sectional shape for reason of its high performance.

The wound core of an approximately circular cross-sectional shape is fabricated by the steps of; cutting a grain oriented silicon steel strip along the predetermined curve of gradually changing the width to the length thus forming a wound core material; winding the material around a specified core while keeping its center line at a fixed position; fixing the end thereof; and performing the working-strain-relieving-annealing for it.

In cutting-off the wound core material, since the grain oriented silicon steel strip is expensive, it has been generally attempted to enhance the utilization factor for the steel strip by straightening one side end of the material, or making two materials adjacent to each other without any gap (see Japanese Patent Publication No. 61-22851 and Japanese Patent Laid-open No. 2-113509).

In the above cutting-off method, the center line of the material is, naturally, made not to be a straight line but a curved line. Consequently, in winding, the material must be shifted in the width direction to be thus deformed for correcting the center line from the curved line to the straight line.

The magnitude of the deformation strain corresponds to that of the curvature of the material center line. In general, the curvature is larger at the winding start portion and the winding end portion. In particular, the curvature of the winding start portion, while being short in the round-length of winding, is larger than that of the winding end portion, that is, being maximum. And the smaller the wound core is, that is, shorter the material length is, the more the curvature is.

The grain oriented silicon steel strip containing silicon in a large amount has a small elongation percentage and a brittle property, and accordingly, it is extremely poor in workability. As a result, in the winding start portion and the winding end portion, particularly of the small size wound core, it is difficult to obtain the desired deformation, thereby often causing such a trouble as performing the winding with the insufficient deformation.

In the winding process or in the next process, these portions tend to yield the positional shifts due to the large strains.

When the wound core is thus formed into the different cross-sectional shape from the desired circular one, there arise the following troubles; namely, in mounting the bobbins, they are impossible to be rotated; or in rotating the bobbins, the material of the wound core is peeled off and deformed thereby causing the breakage of the bobbin.

For one of the measures, there has been proposed a wound core having the winding start portion and the winding end portion which are formed into elliptic shapes, respectively (see Japanese Patent Publication No. 3-55964).

In the wound core of this type, there are formed the gaps between the winding start and the bobbin and between the winding end portion and the bobbin. Accordingly, even if the wound core is formed into such a shape as being slightly deformed from the desired one, the bobbins can be rotated without any trouble. This effect is sufficient for a relatively large size wound core being less in the degree of the deformation in winding, but is insufficient for a small size wound core.

Further, the wound core of this type yields the following inconvenience in cutting-off the material:

In cutting-off the wound core material from the steel strip, the cutting tool must be directed constantly to the tangential direction of the cutting curve, and the material is usually cut continuously in the longitudial direction. Accordingly, the direction of the cutting tool must be instantaneously changed in such a manner that the cutting tool is directed in such a direction as narrowing the width at the trailing end of one material and is directed in such a direction as broadening the width as the leading end of the next material. The time required for the change, however, is actually restricted by the inertias of the cutting tool and the other parts, and consequently, the actual working is performed by restricting the cutting speed such that the directional change is completed within the allowable travel of the material. Thus, the cutting speed is substantially determined by the magnitude of the directional change of the cutting tool at the trailing end of the material.

The elliptic cross-sectional shape at each of the winding end potion and the winding start portion has larger change rate of the width than the circular cross-sectional shape. Accordingly, in cutting-off the material for the wound core of this type, the magnitude of the directional change of the cutting tool at the trailing end of the material is larger, and thus the cutting speed must be lowered.

SUMMARY OF THE INVENTION

It is therefore an object of the present invention to provide a wound core capable of rotating bobbins without any trouble even if the wound core is formed to be slightly deformed, and of improving the cutting speed in cutting-off the material.

A preferred mode of the present invention is a wound core, around which electric wires are to be wound by rotating cylindrical bobbins attached, wherein at least one of a winding start portion and a winding end portion is formed into a trapezoidal cross-sectional shape, and the other portion is formed into a circular cross-sectional shape, thereby forming a gap between the trapezoidal cross-sectional shape portion and the bobbin attached.

DETAILED DESCRIPTION OF THE PREFERRED EMBODIMENTS

Hereinafter, an embodiment of the present invention will be described in detail with reference to the accompanying drawings.

Figure 1:
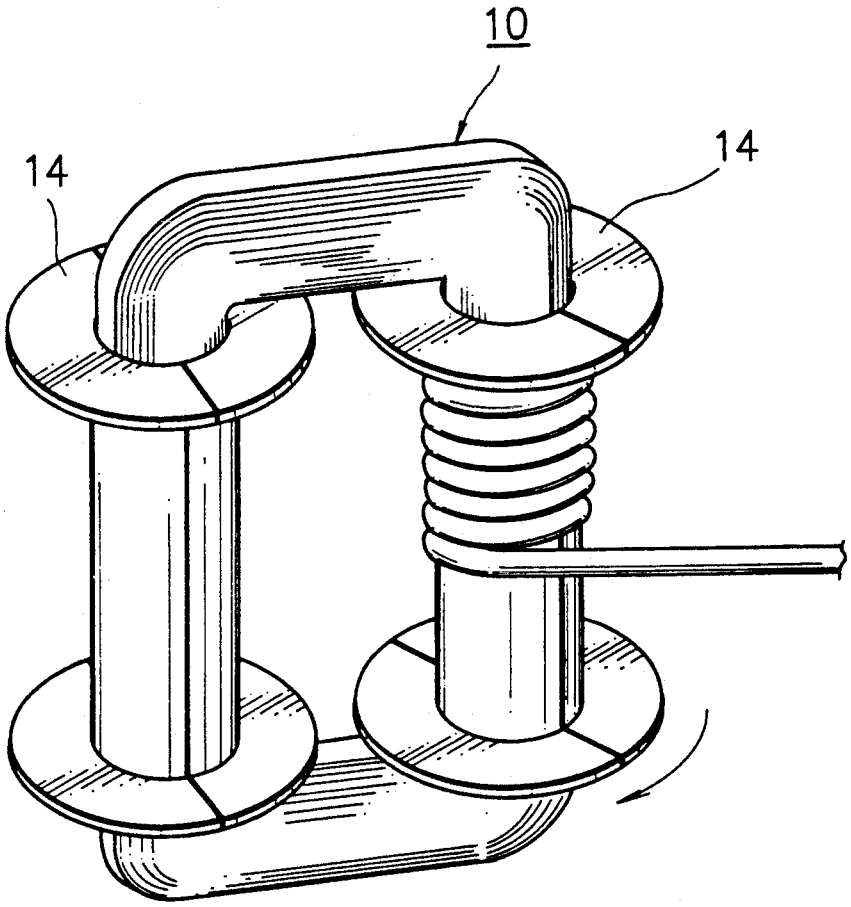
FIG. 1 is a perspective view showing the used state of an embodiment of the present invention.
Figure 2:
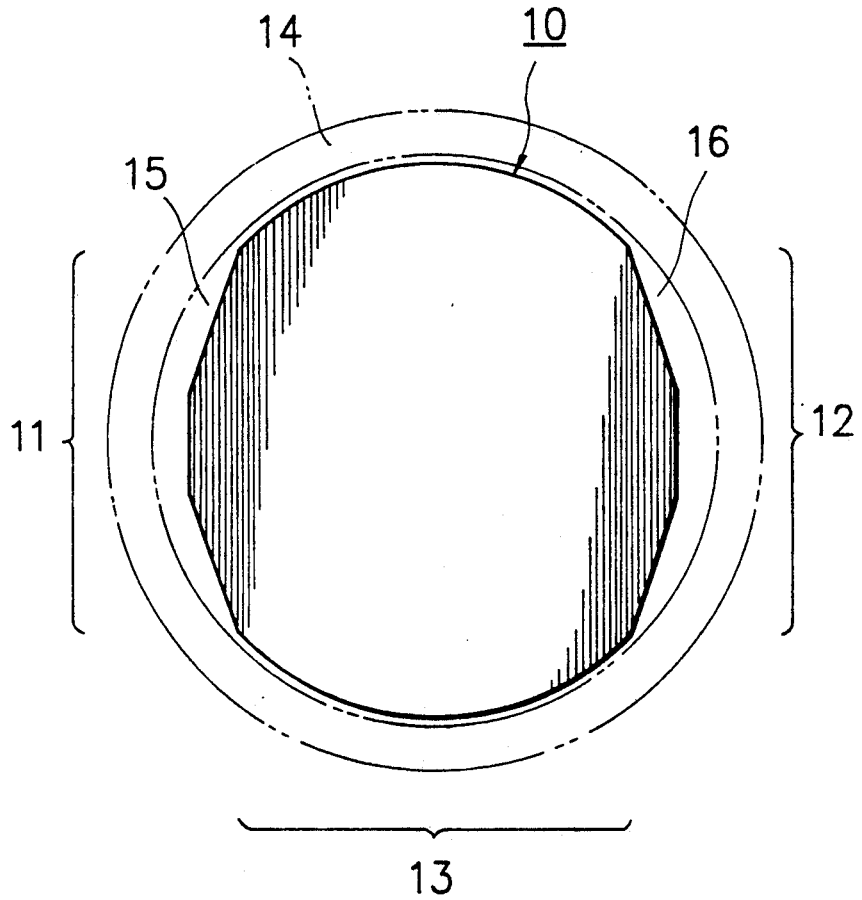
FIG. 2 is a cross-sectional view of a leg of the embodiment as shown in FIG. 1.

In a wound core 10, a winding start portion 11 and a winding end portion 12 are formed into trapezoidal cross-sectional shapes, respectively, and the other portion 13 is formed into a circular cross-sectional shape (see FIG. 2).

Accordingly, when a bobbin 14 is attached, there are formed gaps 15 and 16 between the winding start portion 11 and the bobbin 14 and the winding end portion 12 and the bobbin 14. As a result, even if the material is somewhat shifted at these portions 11 and 12, these portions never touch the bobbin 14, thereby ensuring the rotation of the bobbins 14.

Figure 3:
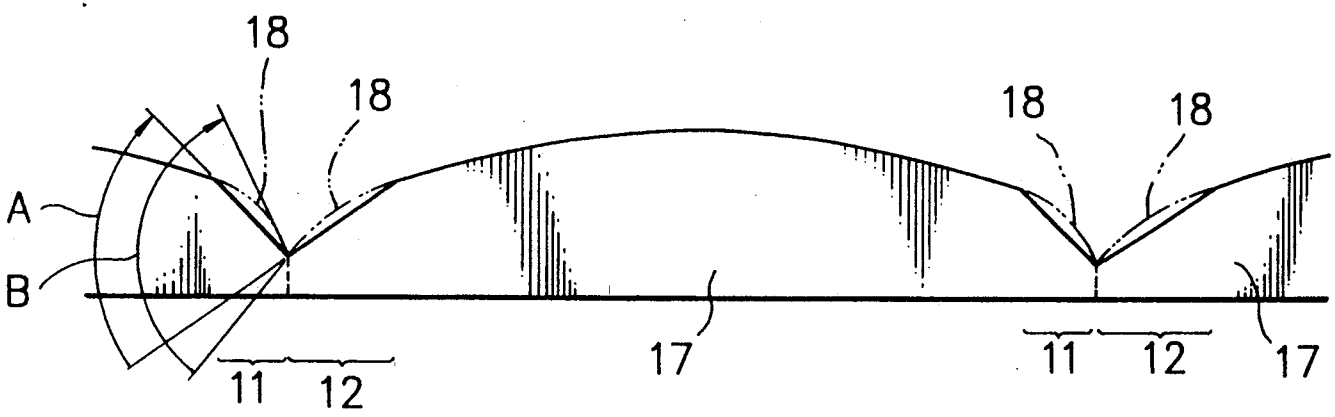
FIG. 3 is a plan view showing the shape of the wound core material in the embodiment as shown in FIG. 1 wherein the longitudinal dimension is contracted in one-several tenth of the width dimension.

A wound core material 17 forming the wound core 10 has such shape as shown in FIG. 3, wherein the width is linearly increased at the winding start portion 11, and is linearly decreased at the winding end portion 12. The conventional wound core material 18 having a circular cross-sectional shape is shown as an overlapped virtual line in this figure. The outline of the wound core material 18 is, naturally, positioned outside the straight lines of the above winding start portion 11 and the winding end portion 12. In cutting-off the material from the right to left in the figure, the directional change angle of the cutting tool at the trailing end and the leading end of the material is the angle A for this wound core material 17, and is the angle B for the wound core material 18. Since the angle A is smaller than the angle B., the cutting speed for the wound core material 17 can be increased as compared with the wound core material 18. As in FIG. 3, the longitudinal dimension is contracted to one-several tenth of the width dimension, the angles A and B are represented larger than the actual ones. However, the magnitude relation of the angle A and B corresponds to the actual one.

Both the winding start portion and the winding end portion are resectivly formed to be trapezoidal in this embodiment; however, only one of the portions may be formed to be trapezoidal. In this case, it is preferable to provide the trapezoidal shape on the winding start portion which are more liable to be shifted, and to provide on the conventional circular or elliptic shape on the winding end portion.

As described above, in the present invention, since the gaps are formed between the winding start portion and the bobbin and/or between the winding end portion and bobbin, it is possible to rotate the bobbin without any trouble even if there occurs a slight positional shift in winding the wound core. Further, since the gaps are sufficiently larger, even if the wound core is finished to be deformed more than the conventional one, the rotation of the bobbin is secured. Therefore, it is achieved to effectively prevent the occurence of the defective products, even in the case of the small size wound core.

In cutting-off the material, since the magnitude of the directional change of the cutting tool at the trailing end and the leading end of the material is decreased, the cutting speed is improved and thus the productivity is enhanced.

What is claimed is:

1. A wound core, for use with electric wires that are to be wound by rotating cylindrical bobbins to be attached to said wound core, wherein at least one of a winding start portion and a winding end portion, of a strip wound to form the core, is formed into a trapezoidal cross-sectional shape, and the remaining portion of the strip is formed into a part-circular cross-sectional shape, thereby forming a gap between the trapezoidal cross-sectional shape portion and a bobbin to be attached.

* * * * *

US005307044B1

REEXAMINATION CERTIFICATE (3938th)

United States Patent [19]

Watabe

[11] B1 5,307,044

[45] Certificate Issued Nov. 23, 1999

[54] WOUND CORE

[75] Inventor: Tadatoshi Watabe, Tokyo, Japan

[73] Assignee: Denki Tetsushin Industrial Co., Ltd., Tokyo, Japan

Reexamination Request:
No. 90/004,682, Jun. 30, 1997

Reexamination Certificate for:

| | |
|---|---|
| Patent No.: | **5,307,044** |
| Issued: | **Apr. 26, 1994** |
| Appl. No.: | **07/971,659** |
| Filed: | **Nov. 5, 1992** |

[30] Foreign Application Priority Data

Sep. 3, 1992 [JP] Japan ..... 4-277645

[51] Int. Cl.[6] ..... H01F 27/24; H01F 27/30

[52] U.S. Cl. ..... 336/198; 29/605; 336/213; 336/234

[58] Field of Search ..... 336/198, 208, 336/213, 233, 234; 29/605, 606

[56] References Cited

U.S. PATENT DOCUMENTS 4,848,684 7/1989 Sasaki et al. .

FOREIGN PATENT DOCUMENTS 0 362 035 A1 4/1990 European Pat. Off. .
1107583 1/1956 France .

*Primary Examiner*—Thomas J. Kozma

[57] ABSTRACT

A wound core, around which electric wires are wound by rotating cylindrical bobbins attached. At least one of a winding start portion and a winding end portion is formed into a trapezoidal cross-sectional shape and the other portion is formed into a circular cross-sectional shape, forming a gap between the trapezoidal cross-sectional shape portion and the bobbin. The rotation of the bobbin without scratch is assured even if the wound core is formed slightly deformed. In cutting-off the material, since the magnitude of the directional change of the cutting tool is decreased at the trailing end and the leading end of the material, the cutting speed is improved.

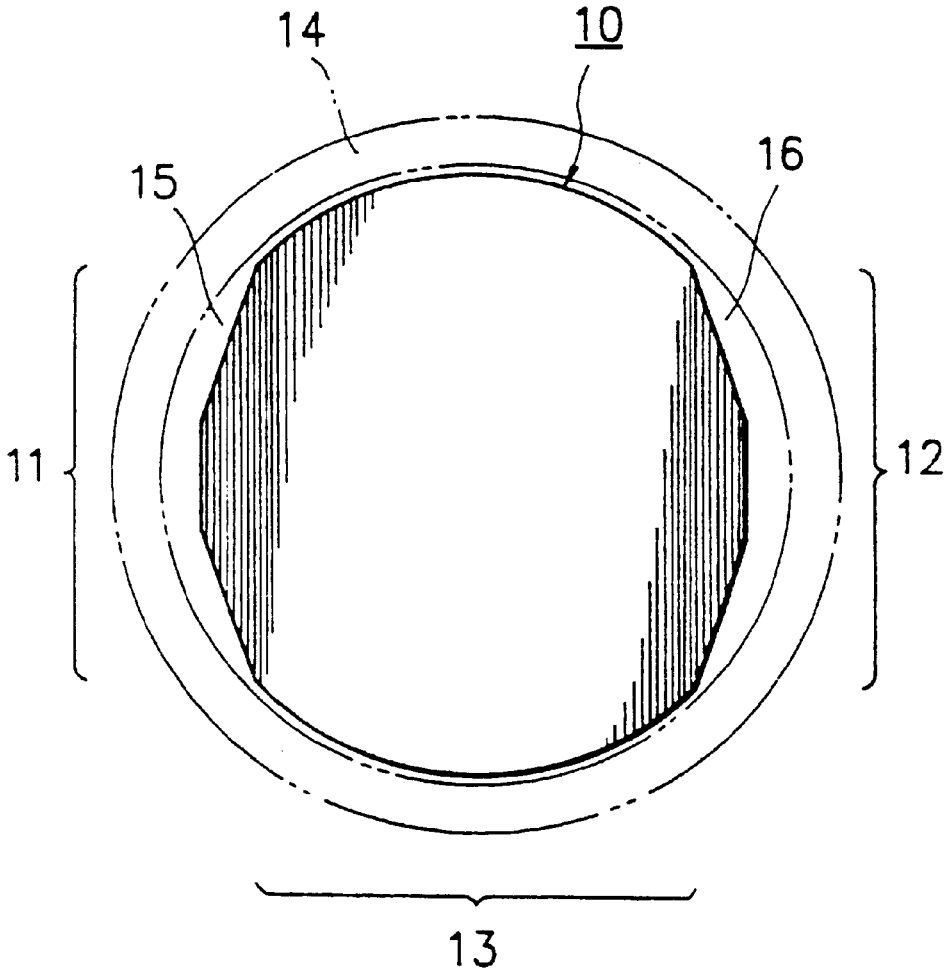

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is cancelled.

New claim 2 is added and determined to be patentable.

*2. A wound core, for use with electric wires that are to be wound by rotating cylindrical bobbins to be attached to said wound core, wherein a winding start portion and a winding end portion, of a strip wound to form the core, are each formed into a trapezoidal cross-sectional shape, and the remaining portion of the strip is formed into a part-circular cross-sectional shape, thereby forming a gap between the trapezoidal cross-sectional shape portion and a bobbin to be attached.*

* * * * *